United States Patent [19]

Thompson

[11] Patent Number: 4,646,857

[45] Date of Patent: Mar. 3, 1987

[54] MEANS TO SECURE CUTTING ELEMENTS ON DRAG TYPE DRILL BITS

[75] Inventor: Charles M. Thompson, Coppell, Tex.

[73] Assignee: Reed Tool Company, Houston, Tex.

[21] Appl. No.: 790,974

[22] Filed: Oct. 24, 1985

[51] Int. Cl.[4] ..... E21B 10/46

[52] U.S. Cl. ..... 175/329; 175/410

[58] Field of Search ..... 175/329, 330, 410

[56] References Cited

U.S. PATENT DOCUMENTS

| | | | |
|---|---|---|---|
| 4,491,188 | 1/1985 | Grappendorf | 175/330 X |
| 4,499,958 | 2/1985 | Radtke et al. | 175/329 |
| 4,515,226 | 5/1985 | Mengel et al. | 175/410 X |

*Primary Examiner*—Stephen J. Novosad
*Assistant Examiner*—Thuy M. Bui
*Attorney, Agent, or Firm*—Vinson & Elkins

[57] ABSTRACT

A metal matrix (53) of a blade (30) on a drag-type rotary drill bit (10) is formed about a plurality of diamond cutting elements (56) so that the entire surface areas of the cutting faces (62) are exposed and engage the formation to be cut in a drilling operation. The cutting elements (56) are secured by a mechanical interlocking bond or attachment (68, 70) between the cutting elements (56) and matrix (53) without utilizing the cutting faces (62) for securement.

10 Claims, 13 Drawing Figures

MEANS TO SECURE CUTTING ELEMENTS ON DRAG TYPE DRILL BITS

BACKGROUND OF THE INVENTION

This invention relates to means for securing cutting elements on drag type drill bits, and more particularly to mechanical interlocking means to secure diamond cutting elements firmly within a metal matrix on drag type drill bits.

Any number of various diamond products are used commercially in drill bits. One such diamond product is a synthetic polycrystalline diamond (PCD) cutting element which in general is fabricated from synthetic and/or natural diamond crystals under heat and pressure in the presence of a catalyst to form the polycrystalline structure.

In one application the PCD cutting element is surface set in a metal matrix provided to hold the diamond cutting element in place, the matrix normally being attached to a steel blank on the drill bit by a suitable metallurgical and mechanical bond. While a natural diamond is normally sufficiently thermally stable to withstand such a bonding process, the polycrystalline diamonds (PCD) forming the cutting elements have at times been thermally unstable at the temperatures of around 2000° F. to 2100° F. used in the formation of the metal carbide matrix. At times, thermal degradation in the PCD cutting elements occurs from expansion of the residual catalyst used in the process of forming the PCD.

However, thermal stable PCD cutting elements are commercially available today and generally have thermally stable properties similar to those of natural diamonds so that such cutting elements can be set in a metal carbide matrix in generally the same way as natural diamonds. It is advantageous to have as large a cutting face as can be obtained, as this improves the cutting action of the drill bit. Polycrystalline synthetic diamonds which are commercially available in a variety of geometric shapes and sizes are manufactured and sold by the General Electric Company under the name "Geoset". As an example, the polycrystalline synthetic diamonds sold under the mark "Geoset 2103" are generally triangular, prismatic-shaped elements and have been found to be substantially thermally stable for the bonding process involved in the metal carbide matrix securing the synthetic diamond cutting elements.

As examples of the prior art, reference is made to U.S. Pat. Nos. 4,491,188 dated Jan. 1, 1985; 4,499,958 dated Feb. 19, 1985; and 4,515,226 dated May 7, 1985; which disclose thermally stable diamond cutting elements in the form of a triangular prism secured to the bit in such a manner that a portion of the planar cutting face is exposed for the cutting operation. However, it is noted that a substantial portion of the planar surface of the cutting face in these references is covered by the adjacent carbide matrix in order to obtain the required securement, thereby reducing the cutting efficiency of the PCD cutting elements.

SUMMARY OF THE INVENTION

The present invention is directed to means for securing such thermally stable diamond cutting elements within a metal carbide matrix for a drag type drill bit which utilizes a mechanical interlocking bond to secure the diamond cutting elements to the metal carbide matrix so that a maximum surface of the cutting face is exposed to engage the formation to be cut. Mechanical interlocking securing means comprise irregularities on the smooth or even surfaces of the PCD cutting elements which mesh or interlock with adjacent surfaces of the carbide matrix to form a strong securing bond between the diamond cutting elements and the metal carbide matrix which has a very high resistance to shear forces. A diamond cutting element secured in such manner is capable of having the entire surface area of the cutting face exposed, without any marginal portion thereof adjacent the metal carbide matrix being covered or gripped in order to secure the cutting face. Maximum use is thus made of the PCD cutting elements which are relatively expensive.

The irregularities provided in the adjacent contacting securing surfaces between the diamond cutting elements and the metal carbide matrix may be provided in a variety of forms. For example, the irregularities may comprise grooves, openings, or other types of voids formed in the smooth or planar surface of one of the members with extensions or projections on the other member filling the void space to provide the desired strong bond between the adjacent contacting surfaces. Also, the irregularity may be provided by a tapering surface on one member which is gripped or anchored by a reverse tapering surface on the other member.

As an example of a suitable PCD cutting element, a triangular prism has been found to function satisfactorily and comprises a pair of planar side faces connected by three equal planar end faces at right angles to the side faces. One of the end faces is the cutting face and its surface area is fully exposed without any portion thereof covered by the adjacent metal carbide matrix. At least one or more of the remaining planar faces of the cutting element have irregularities such as void areas or projections which intermesh or interlock with the adjacent surfaces of the carbide matrix thereby to grip and anchor tightly the cutting element within the slot or opening defined by the adjacent contacting surfaces of the matrix.

It is an object of this invention to provide in a metal carbide matrix a diamond cutting element with a planar cutting face which is capable of being fully exposed to the formation to be cut without any substantial part of the cutting face or cutting surface being covered by the associated metal carbide matrix.

A further object of this invention is to provide anchoring means for the cutting element within the matrix by meshing and cooperating irregularities on the adjacent contacting surfaces of the cutting element and matrix thereby to form a strong mechanical interlocking bond or attachment therebetween for gripping the cutting element tightly within the carbide matrix.

Other objects, features, and advantages of this invention will become more apparent after referring to the following specification and drawings.

DESCRIPTION OF THE INVENTION

Figure 1:
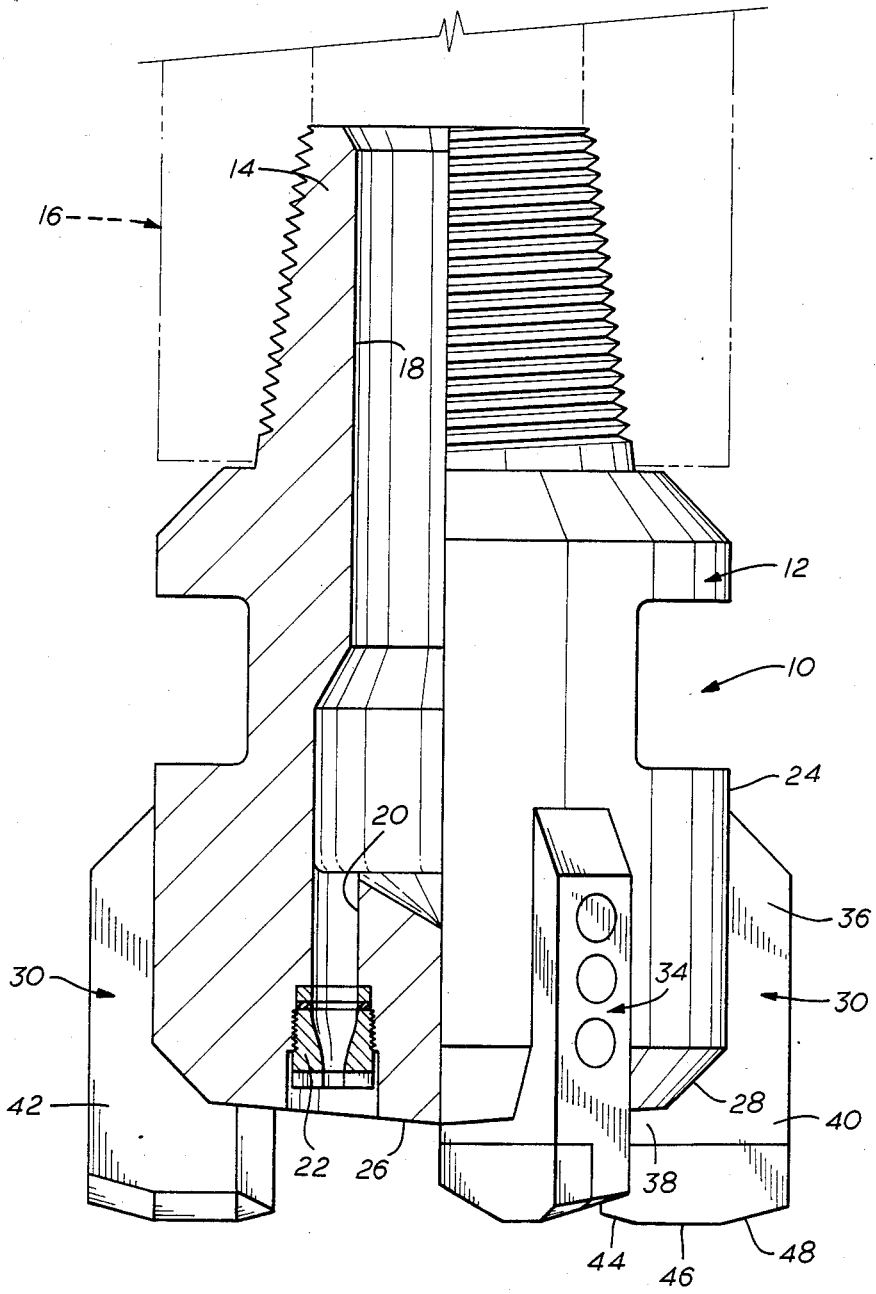
FIG. 1 is the side elevational view, partly in section, showing a drag-type rotary drill bit having cutting blades thereon carrying the cutting elements comprising the present invention, the drill bit adapted to be connected to a drill string for rotation.
Figure 2:
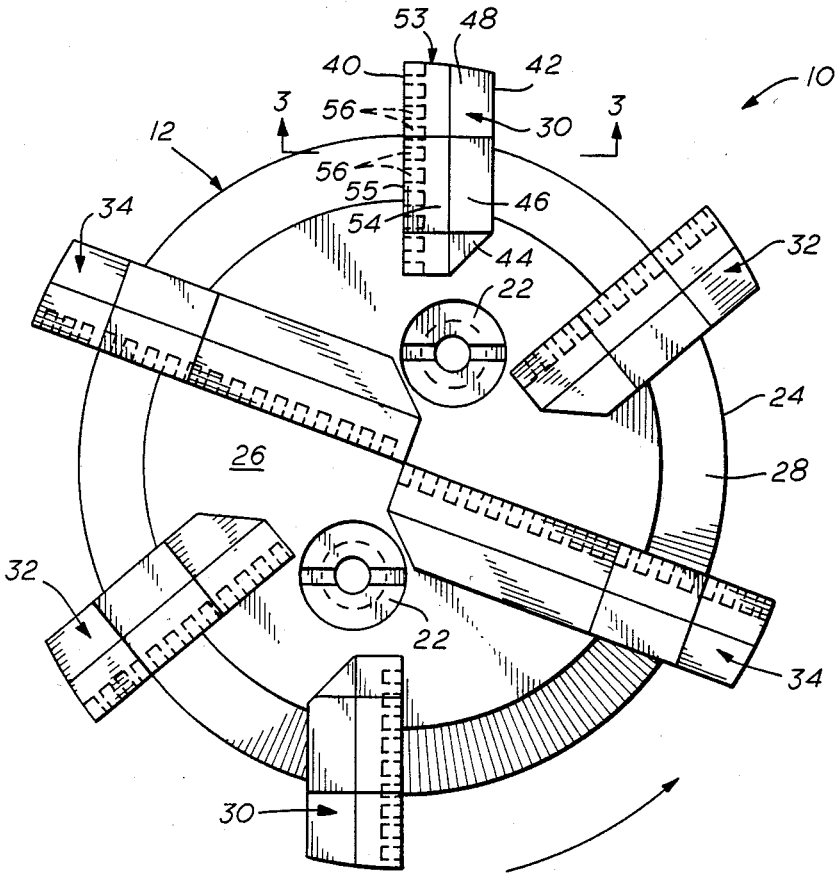
FIG. 2 is a bottom plan of the rotary drill bit shown in FIG. 1 and showing the cutting blades with cutting elements embedded therein extending generally radially from the longitudinal axis of the drill bit.

Referring first to the embodiment shown in FIGS. 1-5, and more particularly to FIGS. 1 and 2, a drag-type rotary drill bit is shown generally at 10 having a generally cylindrical bit body 12 with an externally threaded pin 14 at its upper end. Pin 14 is threaded within the lower end of a drill string indicated generally at 16 which is suspended from a drill rig at the surface for rotating drill bit 10. Drill bit 10 has a longitudinally extending main flow or fluid passage 18 which is adapted to receive drilling fluid or mud from the drill rig for the drilling operation. A reduced diameter fluid passage 20 provides fluid to a discharge nozzle shown at 22 having a suitable discharge orifice for discharging drilling fluid from the lower end of drill bit 10, as is well known.

Body 12 has an outer peripheral surface 24 and a lower base surface 26 which are connected at their juncture by inclined surface 28. Secured to surfaces 24, 26 and 28 are a plurality of generally angle-shaped cutting blades arranged in opposed pairs of blades 30, 32, and 34 which are secured, such as by suitable welding, to surfaces 24, 26 and 28. Each blade 30, 32, 34 is substantially similar except for size and for the purposes of illustration, only blade 30 will be illustrated in detail, it being understood that the remaining blades are generally similar.

Figure 3:
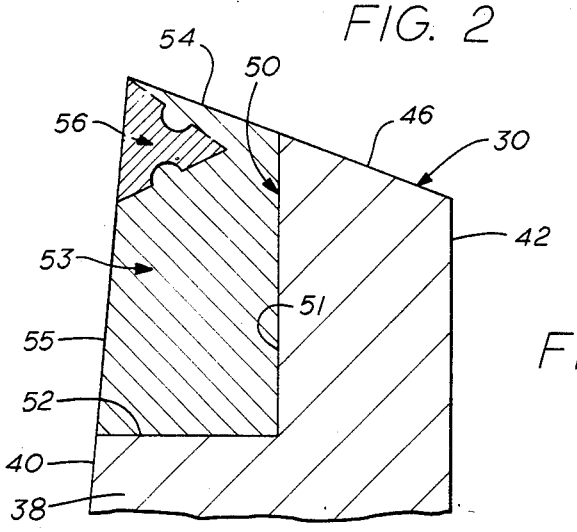
FIG. 3 is an enlarged sectional view taken generally along line 3—3 of FIG. 2 and showing the metal carbide matrix with a cutting element therein mounted on a cutting blade.

Blade 30 has an upper leg 36 secured to surface 24 and a lower leg 38 secured to surface 26. Blade 30 has a leading side 40 in the direction of rotation and a trailing side 42. Lower leg 38 of blade 30 has its lower surface defined by an inner downwardly inclined portion 44, a flat intermediate horizontal portion 46, and an outer upwardly inclined portion 48. The lower surface of blade 30 normally rides along the formation to be cut in a cutting operation. Leading side surface 40 of leg 38 has a slot or groove 50 therein defining surfaces 51 and 52 as shown in FIG. 3. Fitting within slot 50 is a tungsten carbide matrix generally indicated at 53. Matrix 53 has a lower bottom surface 54 which forms a smooth continuation of lower portion 46, and a leading side surface 55 which forms a continuation of leading side surface 40 but is inclined slightly rearwardly with respect to surface 40 in the direction of rotation. Carbide matrix 53 is secured within slot 50, such as by brazing along adjacent contacting surfaces 51 and 52 of the matrix.

Figure 4:
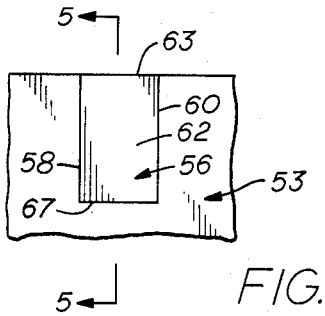
FIG. 4 is a front elevation of the cutting element and matrix shown in FIGS. 1-3.
Figure 5:
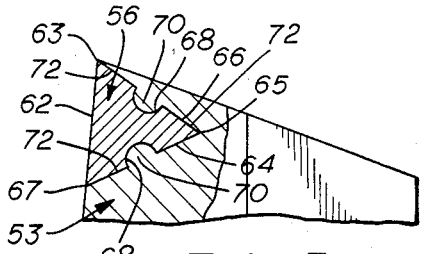
FIG. 5 is a section of the cutting element and adjacent carbide matrix taken along line 5—5 of FIG. 4.

Leading side surface 55 of matrix 53 has a plurality of PCD cutting elements 56 spaced along the length of leg 38. The securing or anchoring means to grip and anchor the PCD cutting elements 56 within matrix 53 form an important part of this invention. All of the cutting elements 56 about which metal matrix 53 is formed are secured in the same manner and for the purposes of illustration, only a single cutting element 56 will be illustrated as shown in FIGS. 4 and 5. The cutting blades may be arranged in different patterns on the outer surface of the drill bit. However, it is desirable for each rotation of the drill bit 180° to have a cutting element contact each portion of the cutting area circumscribed by rotation of the drill bit.

Cutting element 56, as shown particularly in FIGS. 4 and 5, is in the shape of a triangular prism having a pair of planar side faces 58 and 60 which are connected by three end faces 62, 64, and 66 extending at right angles to side faces 58 and 60. End faces 62, 64, and 66 meet at apices to form sharp edges 63, 65, and 67 thereat. Planar end face 62 forms the cutting face for the PCD cutting element 56 and edge 63 forms the sharp cutting edge. It is noted that cutting face 62 is fully exposed so that its entire surface area may engage a formation to be cut in a drilling operation, as no portion or area of face 62 is covered by any of the adjacent material forming matrix 53. End faces 64 and 66 form smooth planar surfaces and have grooves 68 therein which form void areas or indentations in the smooth surface forming faces 64 and 66. Grooves 68 are filled by projections or beads 70 from matrix 53. Projections 70 extend from adjacent planar surfaces 72 of matrix 53 which form a slot or pocket in which PCD cutting element 56 is received or embedded. Thus, grooves 68 and interfitting projections 70 form irregularities in their respective associated surfaces 64, 66, and 72 which interlock to form a strong mechanical bond between cutting element 56 and matrix 53. The cooperating interfitting projections 70 and associated grooves 68 grip and anchor cutting element 56 tightly within the slot or pocket defined by surfaces 72 of matrix 53. In order to obtain an adequate anchoring or securement of cutting element 56 and minimize any loss of PCD cutting elements by dislodgment from matrix 53 resulting from abnormal stresses or long periods of use, it is believed that at least around ten percent (10%) of the surface area of two of the faces of cutting element 56 should have surface irregularities therein. It is noted that metal matrix 53 is normally formed by a suitable molding process about cutting elements 56.

Such irregularities provided in the adjacent contacting surfaces between the PCD cutting elements 56 and metal carbide matrix 53 may be provided in a variety of forms. For example, the irregularities may comprise grooves, openings, or other types of voids formed in the smooth or planar surfaces of one of the members with extensions or projections on the other member filling the void space, thereby to provide a strong mechanically interlocking bond between the adjacent contacting surfaces. Also, the irregularities may be provided by a pair of spaced non-parallel surfaces on the cutting element tapering toward the cutting face with the non-parallel surfaces being gripped or anchored by reverse tapering surfaces on the metal matrix. As examples of the various types and forms of irregularities which will function satisfactorily, several different embodiments are illustrated.

As a specific example for a triangular prism forming diamond cutting element 56, a triangular prism manufactured and sold by the General Electric Company under the name "Geo-Set 2103" has been found to be thermally stable for the bonding process involved in the securement of the diamond cutting elements 56 within metal carbide matrix 53C. Such a triangular prism is around 3.7 mm in thickness and has a side length of 6.0 mm. A temperature of around 1200° C. (2192° F.) is normally reached in the process for forming matrix 53 with PCD cutting elements 56 therein since matrix 53 is formed from suitable tungsten carbide powders under a high temperature in a heated furnace.

Figure 6:
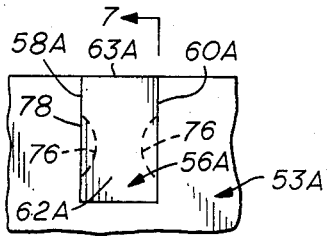
FIG. 6 is a front elevation of a further embodiment of the cutting element and associated metal carbide matrix showing a modified securing means to anchor the cutting element within the matrix.
Figure 7:
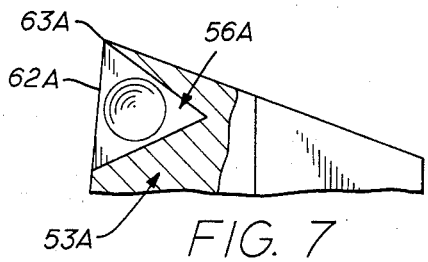
FIG. 7 is a section taken generally along line 7—7 of FIG. 6.

As shown in the embodiment of FIGS. 6 and 7, a cutting element 56A has side faces 58A and 60A with concave surfaces at 76 to form void areas in which projections 78 of matrix 53A fit to provide the interlocking bond. The entire surface of end face 62A and cutting edge 63A is exposed to the formation to be cut as in the embodiment of FIGS. 1–5.

Figure 8:
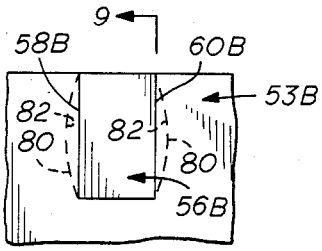
FIG. 8 is an enlarged front elevation of a further embodiment of this invention in which an additional embodiment of the cutting element and securing means for anchoring the cutting element within the associated carbide matrix.
Figure 9:
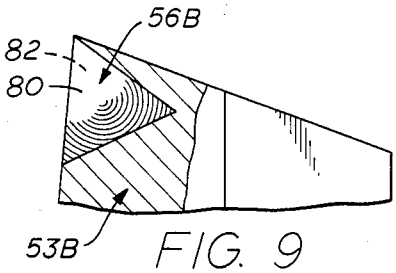
FIG. 9 is a section taken generally along line 9—9 of FIG. 8.

Referring to FIGS. 8 and 9, a further embodiment illustrating a cutting element 56B is shown in which faces 58B and 60B have concave projections 80 extending therefrom within adjacent concave surfaces 82 formed within the receiving slot of matrix 53B. Projections 80 in concave surfaces 82 form interlocking members which tightly grip and anchor cutting element 56B within matrix 53B.

Figure 10:
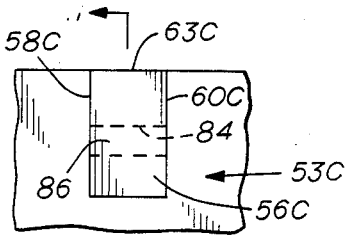
FIG. 10 is a front elevation of a still further embodiment of the cutting element and associated securing means for the cutting element.
Figure 11:
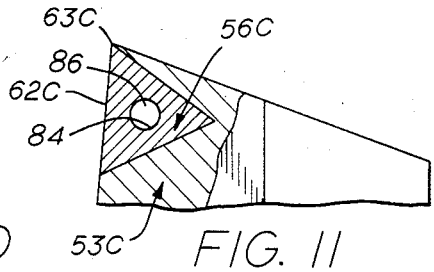
FIG. 11 is a section taken generally along line 11—11 of FIG. 10.

Referring to FIGS. 10 and 11, modified PCD cutting element 56C has side faces 58C and 60C with an opening 84 therethrough filled by projection 86 of matrix 53C thereby to anchor cutting element 56C within matrix 53C. Cutting face 62C and cutting edge 63C are fully exposed to the formation to be cut as in the previous embodiments illustrated. Thus, opening 84 and projection 86 form the interlocking members of cutting element 56C and matrix 53C for anchoring cutting element 56C within matrix 53C.

Figure 12:
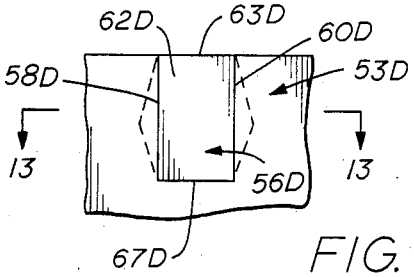
FIG. 12 is a front elevation of another modification of the cutting element and associated securing means.
Figure 13:
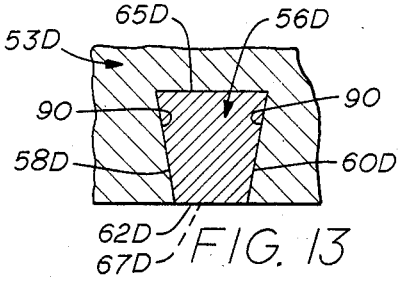
FIG. 13 is a section taken generally along line 13—13 of FIG. 12.

Referring to FIGS. 12 and 13, another modified cutting element 56D is illustrated having a pair of non-parallel side faces 58D and 60D, and an end face 62D. Face 62D forms the cutting surface and has its entire surface between cutting edge 63D and edge 67D exposed to the formation to be cut. Non-parallel faces 58D and 60D have a taper leading to cutting face 62D as shown in FIG. 13 and adjacent matrix 53D has contacting adjacent surfaces 90 which taper in a reverse direction from faces 58D, 60D, and define the slot within which cutting element 56D fits in contact therewith. The taper formed by surfaces 58D and 60D may be around 5° to 10° for satisfactory results. Thus, the taper formed by non-parallel surfaces 58D and 60D tapering toward cutting face 62D and the tapers formed by adjacent contacting surfaces 90 of metal matrix 53D in a reverse direction form irregularities which anchor PCD cutting element 56D tightly within the slot or pocket defined by surfaces 90 of matrix 53D.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. An improved means to secure a polycrystalline diamond cutting element within a slot of a metal matrix of a drag type drill bit with a cutting face of the cutting element terminating at a cutting edge and forming a continuation of the adjacent matrix surface with a maximum surface area of the cutting face adapted to be exposed to an adjacent formation to be cut;

said cutting element having other faces thereof in contact with adjacent surfaces of said matrix defining the slot in which said cutting element is secured;

at least one of said other faces and said adjacent surface having cooperating interfitting irregularities which interlock to form a strong mechanical bond between the polycrystalline diamond cutting element and the metal matrix for gripping said cutting element tightly within said slot thereby resisting stresses resulting from the cutting operation to dislodge said cutting element from said slot;

said cutting element being a triangular prism defining a pair of spaced planar side faces and three planar end faces at right angles to the side faces, one of said planar end faces forming the cutting face and at least one of the remaining planar faces having surface irregularities therein; and said adjacent surface of said matrix defining said slot having surface irregularities interfitting with the surface irregularities of said one of the remaining planar faces and forming cooperating interfitting projections and voids for gripping said cutting element tightly within said slot.

2. The improved means as set forth in claim 1 wherein said surface irregularities on at least one of the remaining planar faces comprises void areas filled by adjacent projections of said matrix thereby to form the interlock.

3. The improved means as set forth in claim 1 wherein said surface irregularities on at least one of the remaining planar faces comprise projections fitting within voids of the adjacent matrix surfaces thereby to form the mechanical interlock.

4. The improved means as set forth in claim 1 wherein the entire surface area of said smooth cutting face of said cutting element is exposed and out of contact with the adjacent matrix

5. A rotary drill bit of the drag type comprising:

a generally cylindrical bit body having a fluid passage therein and adapted to be connected to a drill string for rotation therewith and to receive drilling fluid therefrom for discharge;

a plurality of blades extending generally radially along the lower surface of the bit body from the longitudinal axis thereof;

each of said blades including a metal matrix having a plurality of spaced slots along the leading side of said blade in the direction of rotation;

a plurality of polycrystalline diamond cutting elements within said slots, each of said cutting elements having a cutting face forming a continuation of the adjacent matrix surface and having a maximum surface area adapted to be exposed to an adjacent formation to be cut, each of said cutting elements having other faces thereof in contact with adjacent surfaces of said matrix defining the slots in which said cutting elements are secured;

at least one of said other faces and said adjacent surfaces having cooperating interfitting portions which interlock to form a strong mechanical bond between the polycrystalline diamond cutting elements and the metal matrix for gripping said cutting elements within said slots thereby resisting stresses resulting from the cutting operation to dislodge said cutting elements from said slots;

said cooperating interfitting portions on said one of said other faces comprising surface irregularities defining void areas meshing with cooperating surface irregularities on said adjacent surface defining said slots thereby to form a mechanical interlock.

6. A rotary drill bit of the drag type comprising:

a generally cylindrical bit body having a fluid passage therein and adapted to be connected to a drill string for rotation therewith and to receive drilling fluid therefrom for discharge;

a plurality of blades extending generally radially along the lower surface of the bit body from the longitudinal axis thereof;

each of said blades including a metal matrix having a plurality of spaced slots along the leading side of said blade in the direction of rotation;

a plurality of polycrystalline diamond cutting elements within said slots, each of said cutting elements having a cutting free forming a continuation of the adjacent matrix surface and having a maximum surface area adapted to be exposed to an adjacent formation to be cut, each of said cutting elements having other faces thereof in contact with adjacent surfaces of said matrix defining the slots in which said cutting elements are secured;

at least one of said other faces and said adjacent surfaces having a cooperating interfitting portions which interlock to form a strong mechanical bond between the polycrystalline diamond cutting elements and the metal matrix for gripping said cutting elements within said slots thereby resisting stresses resulting from the cutting operation to dislodge said cutting elements from said slots;

said cooperating interfitting portions on said one of said other faces comprising surface irregularities defining projections meshing with cooperating surface irregularities on said adjacent surface defining said slots thereby to form a mechanical interlock.

7. A rotary drill bit of the drag type comprising:

a generally cylindrical bit body having a fluid passage thereon and adapted to be connected to a drill string for rotation therewith and to receive drilling fluid therefrom for discharge;

a plurality of blades extending generally radially along the lower surface of the bit body from the longitudinal axis thereof;

each of said blades including a metal matrix having a plurality of spaced slots along the leading side of said blade in the direction of rotation;

a plurality of polycrystalline diamond cutting elements within said slots, each of said cutting elements comprising a pair of spaced planar side faces and planar end faces extending between and connecting said side faces, one of said planar end faces defining a cutting face forming a continuation of the adjacent matrix surface and having substantially its entire planar surface area exposed and out of contact with the adjacent matrix surface for contacting an adjacent formation to be cut, and other faces of said one cutting element in contact with adjacent surfaces of said matrix defining the slots in which said cutting elements are secured;

at least one of said other faces and said adjacent surfaces having cooperating interfitting projections and voids which interlock to form a strong mechanical bond between the polycrystalline diamond cutting elements and the metal matrix for gripping said cutting elements within said slots thereby resisting stresses resulting from the cutting operation to dislodge said cutting elements from said slots.

8. A rotary drill bit as set forth in claim 7 wherein the lower surface of each blade comprises an inner downwardly inclined portion, a generally flat intermediate portion, and an outer upwardly inclined portion.

9. A rotary drill bit as set forth in claim 7 wherein the leading side of said matrix is inclined slightly rearwardly with respect to the adjacent blade surface in the direction of rotation.

10. A rotary drill bit of the drag type comprising:

a generally cylindrical bit body having a fluid passage therein and adapted to be connected to a drill string for rotation therewith and to receive drilling fluid therefrom for discharge, said bit body having an outer peripheral side surface and a lower surface through which the drilling fluid is discharged;

a plurality of blades spaced about the periphery of said bit and extending generally radially along the lower surface of the bit body from the axis of rotation;

each blade having a leading side and a trailing side connected by a lower surface which is adapted to ride along the surface of the formation being cut in a cutting operation, said leading side having a groove therein at its juncture with said lower surface;

a metal matrix secured within said groove and having surfaces forming continuations of the adjacent surfaces of said blade, said matrix having a plurality of spaced slots along the leading side of said blade in the direction of rotation;

a plurality of polycrystalline diamond cutting elements within said slots, each of said cutting elements comprising a generally triangular prism defining a pair of spaced opposed planar side faces and three planar end faces extending between and connecting such side faces, one of said planar end faces defining a cutting face forming a continuation of the adjacent matrix surface and having substantially its entire planar surface area exposed and out of contact with the adjacent matrix surface for contacting an adjacent formation to be cut, and other faces of said one cutting element in contact with adjacent surfaces of said matrix defining the slots in which said cutting elements are secured;

said opposed planar side faces defining non-parallel surfaces tapering to said cutting face, and adjacent surfaces of said matrix tapering in a direction opposite to the tapering of said non-parallel surfaces of said cutting elements to form connecting interfitting portions which interlock to provide a strong mechanical bond between the polycrystalline diamond cutting elements and the metal matrix for gripping said cutting elements within said slots thereby resisting stresses resulting from the cutting operation to dislodge said cutting elements from said slots.

* * * * *